United States Patent [19]

Yamagata et al.

[11] 4,415,611

[45] Nov. 15, 1983

[54] ARTIFICIAL FUR HAVING GUARD HAIR FIBERS AND UNDER FUR FIBERS AND A METHOD FOR MANUFACTURING THE SAME

[75] Inventors: Seiichi Yamagata; Masaaki Sakai, both of Otsu, Japan

[73] Assignee: Toray Industries, Inc., Tokyo, Japan

[21] Appl. No.: 300,963

[22] Filed: Sep. 10, 1981

[30] Foreign Application Priority Data

Sep. 22, 1980 [JP] Japan ..... 55-130786

[51] Int. Cl.[3] ..... A01N 1/00

[52] U.S. Cl. ..... 428/15; 156/72; 428/16; 428/89; 428/92

[58] Field of Search ..... 428/15, 16, 89, 92; 156/72

[56] References Cited

U.S. PATENT DOCUMENTS 3,930,106 12/1975 Mihara ..... 428/15

*Primary Examiner*—Marion McCamish

*Attorney, Agent, or Firm*—Austin R. Miller

[57] ABSTRACT

In an artificial fur made from a pile cloth provided with a ground construction and numerous pile fibers projected upward from the ground construction, the pile fibers consist of a first group of pile fibers which form a layer of guard hair in the fur and a second group of pile fibers which form a layer of under fur in the fur, wherein each fiber of the first group is provided with a tapered free end portion and a tapered end portion firmly held by the ground construction; the pile fibers of the first group are longer than the pile fibers of the second group, while the thickness of the main portion of the former is thicker than the thickness of the latter. The above-mentioned artificial fur is manufactured by a first step of forming a material pile cloth provided with a ground construction and numerous yarn-like piles projected upward from the ground construction, and a second step of raising the side of said yarn-like piles. An intermediate step of applying a backing treatment to the pile cloth is preferably applied as a process between the above-mentioned two steps of processing. As a final process, a finishing process is applied to the material pile cloth. A conventional dyeing process can be applied.

40 Claims, 11 Drawing Figures

ARTIFICIAL FUR HAVING GUARD HAIR FIBERS AND UNDER FUR FIBERS AND A METHOD FOR MANUFACTURING THE SAME

FIELD OF THE INVENTION

The present invention relates to an artificial fur and the method for manufacturing same, and in more detail, to an artificial fur having a unique construction and a feel which is quite similar to that of genuine fur of high quality, and also relates to the method for the manufacturing thereof.

DESCRIPTION OF THE PRIOR ART

High quality genuine furs, such as mink, fox, etc., have been recognized as furs of high quality which are almost impossible to artificially produce, because of their excellent feel, excellent luster and special structural features, due, mainly to the hair structure.

Accordingly, such genuine furs still maintain their excellent position in the fur trade as high quality furs, because such genuine furs are recognized as furs which serve as a status symbol and which can be used as an extremely high class raw material for making garments of high fashion. Therefore, many technical proposals have been put forth and research conducted for the purpose of creating artificial furs having excellent qualities similar to those of the above-mentioned high quality genuine furs. However, those technical proposals and research have not resulted in any useful solution with regard to the above-mentioned purpose. The proposed solutions only resulted in artificial furs which could be easily identified as inexpensive artificial fur having inferior qualities when compared with those of the high quality genuine furs.

When an attempt is made to produce an artificial fur having the appearance and qualities of high quality genuine furs, the problem which must first be solved is to establish the process for creating a material having a fur-like construction. However, it must be recognized that the level of the conventional technologies is in an infant stage far from the desired level. If all conventional technologies are considered, it will be realized that it is very difficult to produce advanced technologies in order to create a material having characteristic features similar to the features of genuine furs. These characteristics such structural features as, for example, the distribution of the particular type of hairs, the shape and density of the hairs, the density of the pores of the skin, the two layer construction of fur consisting of the guard hairs and the under fur, this particular construction due to a plurality of guard hairs (or a single guard hair) projected together with the under fur from a single pore of the skin. Therefore, the above-mentioned present situation must be recognized.

Some new technologies such as U.S. Pat. No. 2,737,702 have been disclosed as being comparatively advanced in the field of producing artificial fur. In the technology disclosed by U.S. Pat. No. 2,737,702, a method is proposed for producing an artificial fur by means of a knitting machine from a sliver composed of staple fibers of a first group, which form a layer of so-called guard hair of the fur, and staple fibers of second group, which form the under fur of the artificial fur. In this method, the use of a particular kind of fiber is proposed for the first group of fibers, wherein each fiber is provided with two tapered end portions. It can be recognized that the quality of this artificial fur is similar to genuine fur in that a free end of each of the guard hairs is tapered. Since the free end portions of the guard hairs in the genuine fur are generally tapered, we must recognize the achievement of the above-mentioned U.S. patent, keeping in mind the above-mentioned point of view. However, in the artificial fur disclosed by the above-mentioned U.S. patent, a problem still remains which must be solved in order to create a high quality artificial fur. This problem is mainly due to the characteristic feature of the pile fibers which do not satisfy the qualities required in the combination of the guard hairs. That is, it is the understanding of the inventors that the quality of flutter of the guard hair is insufficient as compared with that of genuine fur. In addition to the above-mentioned inferiority of this feature of artificial fur, the feel of this artificial fur is coarse; particularly, the feel of the guard hairs is rather course, so that a fur-like soft and elegant feel is not realized from this artificial fur. In the research conducted by the inventors, it was found that the above-mentioned problems are mainly due to the structural feature of the guard hairs; that is, the root portion of the guard fibers, which is locked in the ground construction of the artificial fur, is insufficiently thin.

It is the interpretation of the inventors that in genuine fur, the root portion of the guard fibers which projects from the skin is thin, and because of the above-mentioned thinness of the guard hairs in the root portion thereof, the good quality of flutter and the elegant soft feel of the fur is achieved. Therefore, in artificial fur, in spite of introducing the above-mentioned advanced technology, whereby the structural feature of the guard hair is created by utilizing staple fibers having two tapered end portions, and a good appearance similar to genuine fur is created, since no particular consideration has been directed to the constructional feature of the guard hairs at their root portions, in other words, since the thickness of the guard hairs at the root portion is the same as the main portions thereof, the characteristic feature of the pile fibers of this artificial fur is inferior to that of genuine fur. It was further recognized that the locked condition of the pile fibers to the ground construction is quite different from the condition present in genuine fur. Therefore, when the inventors design a pile fabric for producing an artificial fur according to the present invention, they believe it is necessary to study the fundamental structural features of genuine fur in detail.

SUMMARY OF THE INVENTION

The principle object of the present invention is to produce an artificial fur having characteristic features similar to the features of high quality genuine fur, such as the structural features, appearance and feel.

The other object of the present invention is to provide a unique method for manufacturing the above-mentioned artificial fur.

In this specification, the term "pile cloth" means a pile fabric provided with a woven or knitted ground construction with or without backing substance and numerous pile fibers projected upward from the ground construction, a pile cloth provided with a non-woven ground construction with or without backing substance and numerous pile fibers projected upward from the ground construction of non-woven cloth.

The principal object of the present invention can be attained by providing a pile cloth comprising a ground construction and numerous units of pile fibers projected upward from said ground construction, each unit of pile fibers provided with a yarn-like bundle of a root portion, at least a main part of said root portion firmly locked in the ground construction, the pile fibers of each unit being separated from each other from the position above the root portion, the pile fibers being made from fibrous materials and provided with varied lengths thereof in a range from almost zero to almost identical to the maximum length of the fibrous materials.

The above-mentioned principle object of the present invention can be further attained by providing a pile cloth comprising a ground construction and numerous units of pile fibers projected upward from the ground construction, wherein the pile fibers consist of a first group of pile fibers which form a layer of guard hairs in the artificial fur and a second group of pile fibers which form a layer of under fur in the artificial fur, each fiber of the first group is provided with at least a tapered free end portion and a tapered end portion firmly held by the ground construction; the pile fibers of the first group are longer than the pile fibers of the second group, while the thickness of the main portion of the former is thicker than the main portion of the latter. It is one of the characteristic features of the artificial fur according to the present invention that numerous units of pile fibers are firmly locked into the ground construction. In other words, each unit of pile fibers is provided with a yarn-like bundle portion firmly locked into the ground construction. In the research conducted by the inventors, it was confirmed that to attain the purpose of the present invention, it is preferable to form a type of pile fiber unit wherein the above-mentioned pile fibers of the two groups coexist in each unit of pile fibers.

The second object of the present invention can be attained by a unique method for producing the pile cloth comprising a ground construction and numerous units of pile fibers projected upward from said ground construction wherein a part of said pile fibers form under fur while another part of said pile fibers function as guard hairs projected upward from the ground construction, wherein a part of the pile fibers form under fur while another part of the pile fibers function as guard hairs projected upward from the ground construction; comprising a first step of creating a construction of pile cloth consisting of a ground construction and numerous yarn-like pile units projected upward from said ground construction by utilizing a yarn-like substance; a second step of raising the pile cloth so that some of said fibers of which are not firmly held by said ground construction are removed, while opening said fibers, which are firmly held by said ground construction; a third step of finishing the product of the second step.

To further attain the second object of the present invention, the following method for producing the pile cloth has been created based on research conducted by the inventors. That is, in this method, a pile cloth is first made utilizing a thread-like substance as a yarn for forming the piles. This thread-like substance is composed of staple fibers of a first group which form pile fibers of the first group of the above-mentioned artificial fur and staple fibers of a second group which form pile fibers of the second group of the above-mentioned artificial fur. In this first step, particular consideration is directed to the length of pile yarn projected upward from the ground construction before a cutting or raising operation. That is, the length of the pile yarn from the upward surface of the ground construction should not be shorter than the maximum length of the first group of fibers. More precisely, the length of the pile yarn L should not be shorter than the length defined by maximum fiber length or mean length of the component fibers of said pile yarn minus the effective locking length of a pile in the ground construction. The effective locking length of a pile is defined hereunder. Then, the pile cloth is subjected to the process for removing fibers contained in the pile which are not firmly held by the ground construction. This removing operation is normally carried out by applying a raising operation to the pile projected from the ground construction. According to the removing operation, each pile yarn is changed to a unit of a plurality of pile fibers projected from the ground construction. An intermediate operation of applying backing treatment to the ground construction can be applied as an intermediate step between the above-mentioned first step of producing a pile cloth and the second step of removing free pile fibers from the ground construction.

To create a better appearance, and other features similar to the guard hairs and the under fur of genuine fur, finishing operations, such as a softening treatment of the above-mentioned pile cloth by some chemical agent, for example, by silicon emulsion, such as an additional raising operation, are applied to the pile cloth.

Regarding the color of the artificial fur of the present invention, so-called dyed fiber material, such as dope dyed fiber material, can be used to attain this purpose. Conventional yarn dyeing, fiber dyeing or piece dyeing technology can be also applied to produce an artificial fur having a colored appearance. According to research conducted by the inventors, it is also appropriate to use dyed yarn to form the pile cloth. However, in this case, it is necessary to apply a rather strong raising operation to the pile yarns of the cloth, because there is a strong tendency to resist the raising action of the pile fibers from the pile yarns.

DETAILED DESCRIPTION OF PREFERRED EMBODIMENTS

Figure 1:
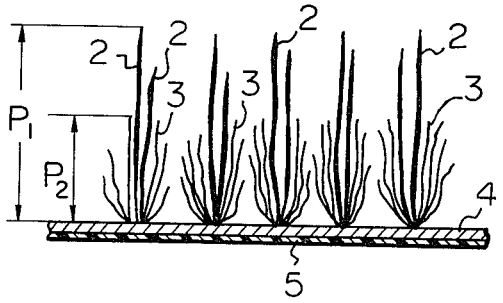
FIG. 1 is a schematic side view of an embodiment of the artificial fur according to the present invention.

Generally speaking, a pile cloth composed of a ground construction and a plurality of pile fibers projected upward from the ground construction can be utilized as the material construction for producing artificial fur according to the present invention. A conventional power loom for producing a single or double pile fabric, a conventional knitting machine for producing pile knit goods or a tufting machine is preferably used for producing the above-mentioned pile cloth. Besides utilizing the above-mentioned conventional technologies to produce the pile cloth for producing artificial fur, according to the present invention, various methods for producing a pile substance, such as a method for firmly fixing a plurality of pile-yarns on a suitable ground cloth by utilizing a suitable known fixing agent, can be used.

The structural features of the pile cloth as a material for producing an artificial fur, according to the present invention, is explained in detail hereinafter with reference to drawings of a preferred embodiment shown in FIGS. 1, 2 and 3. In the pile cloth shown in FIG. 1, pile fibers of the first and second groups 2 and 3 are projected upward from a ground construction 4 provided with a backing layer 5 which covers the undersurface of the ground construction 4, and these fibers 2 and 3 form a layer thereof. Each pile fiber 2 is provided with at least a tapered free end portion. The above-mentioned pile fibers 2 form a layer of guard-hair-like pile fibers, having a maximum fiber length $P_1$. On the other hand, numerous pile fibers 3, the thickness of which is relatively finer than that of the main portion of the above-mentioned guard-hair-like pile fibers 2 form a part of the above-mentioned layer of pile fibers. The length of these fine pile fibers 3 is shorter than the pile fibers 2 and the maximum length thereof projected from the ground construction is represented by $P_2$ in FIG. 1. The fine pile fibers 3 form a portion corresponding to a layer of under fur of the artificial fur according to the present invention. In the pile cloth according to the present invention, it is not always necessary to have the structural features which are characterized by the above-mentioned two distinguishable layers of the pile fibers 2 and the layer of the finer pile fibers 3. However, if it is intended to produce an artificial fur having a similar appearance and feel to genuine mink, it is desirable to produce pile cloth having the structural features shown in FIG. 1, wherein two different layers of the pile fibers 2 and 3 can be identified as clearly as possible. In this case, it is important that the maximum length $P_1$ of the pile fiber 2 be larger than the maximum length $P_2$ of the pile fibers 3.

In the above-mentioned pile cloth, the length of pile fibers which are projected upward from the ground construction thereof varies from almost zero to the maximum fiber length of the material fiber. It is preferable that the thickness of the guard-hair-like pile fibers 2 having a sharpened tip end portion, vary along the lengthwise direction from thin at the root portion thereof to thick at the main portion thereof.

In the pile cloth shown in FIG. 1, many pile fibers 3 and a comparatively smaller number of pile fibers 2 are projected upward from a ground construction 4 in a bundled condition to form units of pile fibers. Such units of pile fibers are formed in a yarn-like bundle of fibers at the stage of producing a pile cloth which is utilized to make the artificial fur according to the present invention.

Figure 2:
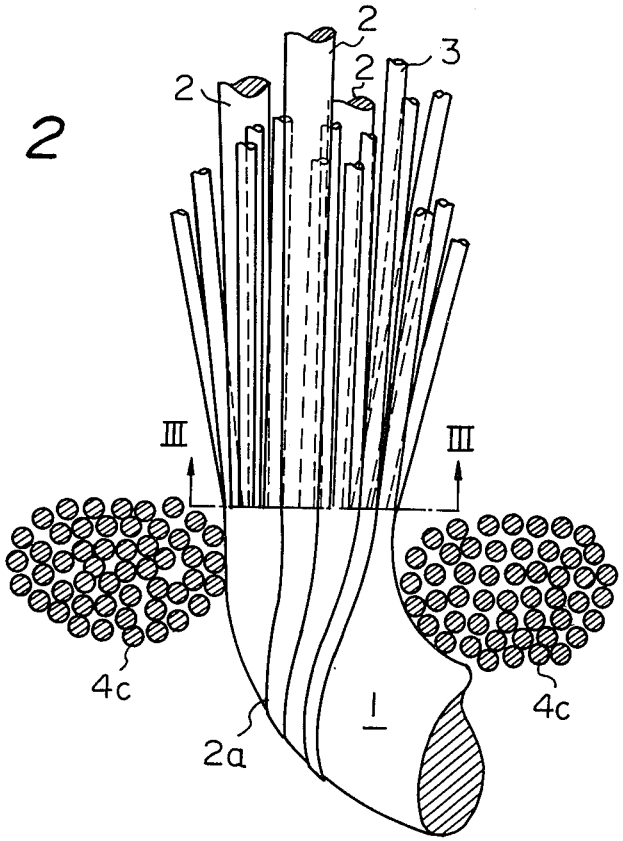
FIG. 2 is an enlarged schematic side view of each unit of pile fibers projected upward from the ground construction of the artificial fur according to the present invention, wherein the root portion thereof is shown.

Therefore, as shown in FIG. 2, the unit of pile fibers 2 and 3 is provided with a yarn like root portion 2*a* firmly woven into the ground construction provided with yarns 4*c*.

Figure 3:
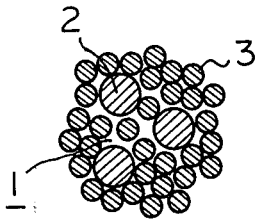
FIG. 3 is an enlarged cross section of the unit of pile fibers taken along the upper surface of the ground construction, which is represented by the line III—III in FIG. 2.

As shown in FIG. 3, wherein a cross section of a pile yarn of the pile cloth according to the present invention cut at its root portion is shown, each unit of a pile consists of many thin pile fibers 3 of the second group and a comparatively smaller number of pile fibers 2 of the first group. It is one of the characteristic features of the present invention that the pile fibers 2 and 3 are distributed uniformly in a surface of the ground construction 4 (FIG. 1) from where those pile fibers 2 and 3 are projected upward.

Figure 4A:
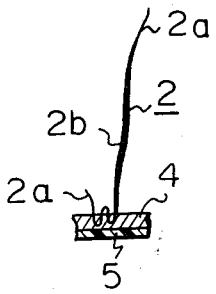
FIGS. 4A and 4B are schematic side views of a pile fiber of the first group firmly held by a ground construction of the artificial fur shown in FIG. 1, respectively.
Figure 4B:
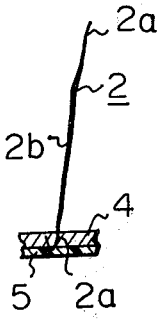

As shown in FIGS. 4A and 4B, in the above-mentioned preferable embodiment of the present invention, the pile fiber 2 of the guard hair is created by utilizing a fiber material having two tapered end portions. Therefore, if a single fiber 2 of the guard hair firmly held by the ground construction 4 is observed, it was confirmed that the tapered bottom end portion of this fiber 2 is locked into or entangled with the ground construction 4 in the shape of the letter "U" or "W," or in the shape of triple folded condition. Therefore, it can easily be said that the construction of the pile cloth at the root portion of each unit of the pile fibers is quite similar to the structural feature of the guard hairs and the under fur of genuine fur at the root portion thereof. It is the interpretation of the present inventors that, because of the above-mentioned structural feature of units of pile fibers, a harmonized combination of the pile fibers 2 with the pile fibers 3 can be created so that, when the surface of the pile cloth is stroked by hand along the lie of hair or in the reverse direction thereof, the motion of the pile fibers 2 and 3 and the feel approach that of genuine fur. However, the above-mentioned characteristic features, mainly due to the structural feature of the pile cloth such as the harmonized combination of the pile fibers 2 and 3 at the root portion of each unit of pile fibers, thickness variation of pile fibers 2 of the first group, difference in thickness and length between the pile fibers 2 and the pile fibers 3, etc., cannot be obtained from conventional technologies. It is preferable to firmly fix the bottom portion of each unit of pile fiber woven into the ground construction 4, by forming a backing layer 5 by using a chemical substance on the undersurface of the ground construction 4. Such a chemical substance can be chosen from various high polymer elastic substances in accordance with the purpose. For example, soft polyurethane can be used as a preferable backing substance to produce the pile cloth as a material for producing a high grade artificial fur.

If the pile fibers 2 and 3 can be firmly held by the ground construction 4, the above-mentioned formation of layer 5 of backing substance can be omitted.

As to the modification of the above-mentioned embodiment, it is also practical to form numerous units of pile fibers projected upward from the ground construction of the pile cloth, wherein each one of a part of the numerous units is formed by the pile fibers 2 while each one of the remaining part of the numerous units is formed by the pile fibers 3, and those two kinds of units are uniformly distributed on the ground construction. Such construction can be produced by two kinds of pile yarns wherein one of them is formed by one of material fibers of two groups while the other is formed by the other material fibers of two groups.

In research conducted to develop the present invention, it was found that the following conditions are preferable to attain the purpose of the present invention. That is, the density of the pile fibers is at least $5\times10^3/cm^2$, while the density of the guard-hair-like pile fibers 2 is at least $150/cm^2$; the thickness of the thickest portion of the pile fibers 2 is in a range between 15 and 100 denier, while the thickness of the pile fibers 3 varies from 0.5 to 10 denier.

Next, the method for producing the pile cloth is explained in detail.

Figure 5A:
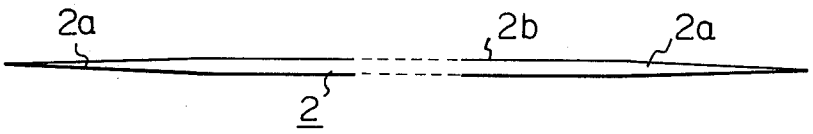
FIGS. 5A and 5B are the schematic side views, respectively, of the staple fiber having a definite length, which is utilized as a material fiber of the first group for creating a guard hair included in the pile yarns.
Figure 5B:
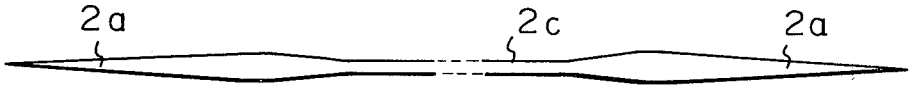

As a material for forming the guard-hair-like pile fiber 2, a staple fiber having a particular shape mentioned hereinafter is preferably utilized. That is, a staple fiber having two tapered end portions 2*a* and an intermediate thick portion 2*b* between two portions 2*a* as shown in FIG. 5A, or a staple fiber having two tapered end portions 2*a* and at least one thin portion 2*c* formed at the intermediate portion between two end portions 2*a* as shown in FIG. 5B, or a material having a shape similar to those staple fibers, is preferably used as the material for forming the guard-hair-like pile fiber 2. A material for the pile fibers having such particular shape can be made by means of the following known technologies. For example, by applying a method for dissolving or melting both end portions of a staple fiber having a uniform thickness along the lengthwise direction, a method of applying a non-uniform take-up speed at the spinning stage, or a method of utilizing a revolving nozzle in a spinning pack at the spinning stage. The length of this staple fiber for creating the guard hair like pile fiber 2 must be chosen so as to satisfy the functional features of the pile fibers as the guard hairs of artificial fur produced from this pile cloth, which were described hereinbefore. To simplify the following explanation, the fiber or fibrous material to create the pile fiber 2 and the fiber or fibrous material to create the pile fiber 3 are designated as fiber (of a first group) "a" and fiber (of a second group) "b," respectively.

As for the staple fiber to be used for creating the pile fiber "2" and pile fiber "3" in the present invention, conventional synthetic fibers such as a polyester fiber, polyamide fiber or acrylic fiber, natural fibers such as cotton fiber, wool, flux etc., regenerated fibers such as rayon staple fiber, other artificial fibers such as acetate fiber or triacetate fiber can be satisfactorily used. However, in experiments conducted by the inventors, it was found that the polybutylene terephthalate fiber is preferably utilized as the fiber "a" of the first group to create the guard-hair-like pile fiber.

Regarding the cross-sectional shape of those fibers "a" and "b," fibers having a circular cross-section or another geometrical shape can be utilized, and if necessary, fibers treated by alkali solution can be used.

To produce a pile cloth according to the present invention wherein the pile fibers of guard hair can be clearly identified from the fiber layer of under fur, it is desirable to use such pile yarn composed of two fibers "a" and "b" in blended condition, wherein the difference in the fiber length between those two fibers "a" and "b" is remarkably large. It is also preferable to use fiber material having a heat-shrinkable property as the fiber "b" to clearly identify the pile fibers of guard hair from the fiber layer of under fur in the final product. In this case, after producing the pile cloth of the present invention, this pile cloth is subjected to a suitable known heat treatment so as to create shrinkage of the pile fibers.

As to the thread-like substance or a yarn for forming the pile of the cloth to produce an artificial fur according to the present invention, a yarn composed of a staple fiber having the function of the guard-hair-like pile fibers 2 and another staple fiber having the function of the pile fiber 3 in a blended condition is preferably utilized. In this specification, as previously indicated, the former staple fibers and the latter staple fibers are identified as the staple fibers of the first group and the staple fibers of the second group, respectively.

As to the above-mentioned thread like substance, a yarn with twists or a bundle of fibrous materials tightly condensed without twists can be used to attain the purpose of the present invention. Therefore, if the fiber arrangement along the longitudinal direction of the yarn is imagined, it is possible to understand that those fibers are arranged in an aligned condition with a certain shear as shown in FIG. 6, wherein the fiber arrangement of the fiber of the first group only is shown.

When the above-mentioned material yarn is used to produce the pile cloth according to the present invention, it is required to design the construction of the pile cloth in such condition that the length of the pile yarn "L" is not shorter than the length defined by the maximum or mean fiber length of the component fibers of the pile yarn minus the effective locking length of the pile in the ground construction, wherein the effective locking length of the pile means the length of the root of said unit of pile locked or anchored in the ground construction. It was confirmed by experiments conducted by the inventors that the length of the root portion varies in accordance with the construction of the ground construction. However, it is preferable to have a length which is 5 times the thickness of the ground construction.

Figure 6:
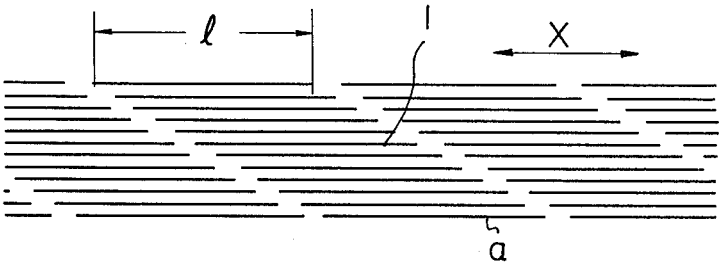
FIG. 6 is a model drawing of a pile yarn indicating the arrangement and alignment of fibers of the first group in the construction of the pile yarn, which fiber is provided with two tapered end portions, according to the present invention; wherein l represents the mean fiber length or maximum fiber length of component fibers of said pile yarn.

In FIG. 6, which depicts a model of the fiber arrangement in the pile yarn in an imaginary condition without twist, the mean length of the fiber "a" of the first group is indicated as l.

Figure 7:
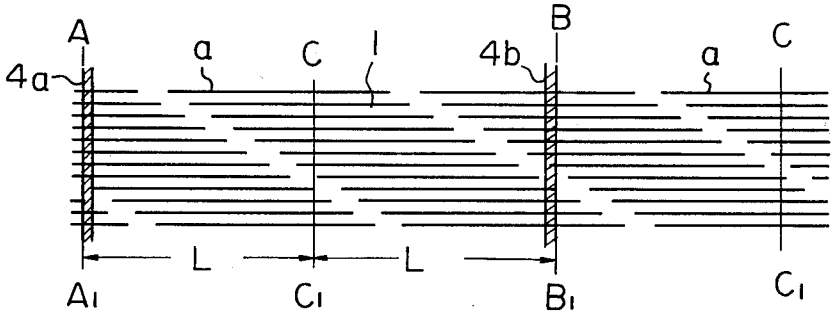
FIG. 7 is a model drawing of the pile yarn shown in FIG. 6, in the case of utilizing this yarn for producing an artificial fur according to the present invention, wherein the length of cut pile yarn of the cloth is L and the yarn is divided by a plurality of straight lines c—c, perpendicular to the lengthwise direction of the yarn on the condition that the distance of two adjacent straight lines including the effective locking length of the pile is L.
Figure 8:
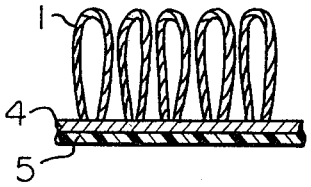
FIG. 8 is a schematic side view of the pile cloth provided with a plurality of loop piles having the loop pile length L.

As explained in the introduction of this specification, a conventional method for producing a pile cloth can be utilized as the first step for producing the pile cloth according to the present invention. For example, a conventional method for producing a pile fabric composed of a woven ground construction and numerous loop piles projected upward from the ground construction, as shown in FIG. 8 or conventional method for producing a pile fabric comprising the first step of producing a fabric wherein two ground constructions are connected by a plurality of pile yarns woven into the ground constructions, and the second step of cutting the pile yarns at a central intermediate portion between the two ground constructions, is one of the methods which can be employed for producing a pile cloth for producing the artificial fur according to the present invention. If only a single pile yarn of the pile cloth provided with two ground constructions described in the above-mentioned method is considered, the fiber arrangement in the pile yarn can be imagined to be similar to that shown in FIG. 6 as shown in FIG. 7. Since the pile yarn 1 is cut at the central intermediate position between two ground constructions 4*a*, 4*b* of the pile fabric in the second step, it can be imagined in the model of fiber arrangement that the yarn 1 is cut at a central intermediate position $CC_1$ between the respective ground constructions 4*a* and 4*b* of the pile cloth, as shown in FIG. 7. In FIG. 7, the thickness of the above-mentioned ground constructions 4*a* and 4*b* represents the length of the root portion of each unit pile 1, which is firmly held by the respective ground constructions 4*a* and 4*b*, and the distance L between two lines $AA_1$ and $CC_1$ or the distance between two lines $BB_1$ and $CC_1$, represents the length defined by "the length of pile projected upward from the ground construction" plus "the length of the root portion of the above-mentioned pile."

To facilitate understanding of the present invention, in the model shown in FIG. 7, the model of the fiber arrangement of the fiber "a" of the first group is only shown. To attain the purpose of the present invention, the length L should not be shorter than the maximum length l of the staple fiber "a." (In this example, L is rather shorter than l). Therefore, it may be understood that each cut pile is projected upward from the respective ground constructions 4*a* and 4*b* wherein those cut piles are firmly held. In this condition, some of the material fibers "a" of the first group and the material fibers "b" of the second group involved in the pile yarn 1 are not substantially held by the respective ground constructions 4*a* and 4*b*. In other words some of the material fibers "a" and "b" of the first and second groups involved in the pile yarn 1 are substantially free from the respective ground constructions 4*a* and 4*b*. Therefore, such free fibers can easily be removed from the ground constructions 4*a* and 4*b* by applying a removing action such as a conventional raising action. As was explained hereinbefore, the amount of the thin material fiber "b" of the second group is larger than that of the thick material fiber "a" of the first group, while the length of the fiber "b" of the second group is shorter than that of the fiber "a" of the first group, and consequently, the amount of fiber "b" of the second group removed from the respective ground constructions 4*a* and 4*b* is much larger than that of the fiber "a" of the first group. Therefore, when the double fabric to produce the pile cloth according to the present invention is designed, the rate of removing fibers must be carefully considered. In the actual step of producing the artificial fur according to the present invention, the raising operation can be applied to the fabric just after completing the cutting operation of pile yarns 1 or after firmly fixing the pile yarn 1 to the respective ground constructions 4*a* and 4*b* by means of a chemical treatment such as a backing operation. After completion of the raising operation, the desired structural feature of the pile cloth characterized by the pile fibers 3 of the second group covered with a layer of the longer guard-hair-like pile fibers 2, wherein each guard-hair-like pile fiber 2 of the first group is provided with at least a tapered free end portion and a thin root portion projected upward from the ground construction 4, as shown in FIG. 1, can be created.

In the above-mentioned embodiment, it may be understood that the ground construction, or the ground construction having received a chemical treatment such as a backing operation, functions as the base portion to which the pile fibers 2 and 3 are affixed.

When the fabric to produce the artificial fur according to the present invention is designed, it is necessary to consider the relation between the length of cut pile 1 and the length of the fibers of the first and second groups, because the relationship between the layer of pile fibers 2 of the first group and the layer of the pile fibers 3 of the second group is very important in determining the functional features of the artificial fur which is the final purpose of the present invention. The condition of L is stated hereinbefore. However, there is a certain allowance regarding the above-mentioned condition. That is, in a case where L is a little shorter than l, since both end portions of the material fiber "a" of the first group are tapered even if the tip portion of the material fiber "a" firmly held by the ground construction 4*a* or 4*b* is cut, the cut end portion of the fiber "a" of the first group, which becomes one of the pile fibers 2, still has a thickness smaller than the thickness of the main portion thereof. Consequently, the appearance of the pile fabric produced after the cutting operation and raising operation does not have any serious defects which cause the appearance to deteriorate. According to experiments conducted by the inventors, it is also possible to produce the pile fabric according to the present invention very effectively if the length L of the pile yarn 1 is sufficiently longer than the maximum length l of the material fiber "a" of the first group, and any possibility of cutting the sharpened end portion of the fiber "a" of the first group can be prevented. However, in this condition, it must be recognized that the number of fibers free from the ground construction 4 becomes very large, so that the loss of fibers cannot be overlooked from a practical point of view. Therefore, the relation between the length L of the cut pile yarn 1 and the maximum length l of the material fiber "a" of the first group is one of the very important factors in producing the pile cloth according to the present invention.

In the above-mentioned embodiment, a blended spun yarn composed of the fiber "a" of the first group and the fiber "b" of the second group is utilized as a pile yarn 1. However it must be understood that the blended spun yarn is one of a thread-like substance which can be utilized as a pile yarn to produce pile cloth according to the present invention. Besides the blended spun yarn, a thread-like substance having such construction that elements of two fiber components provided with definite respective lengths are arranged along the longitudinal direction thereof with a certain shear as shown in FIG. 5 and each element is provided with two tapered end portions, can be used as material to form pile yarn for producing the pile cloth according to the present invention. Since the blended spun yarn satisfies the required condition hereinbefore explained and such spun yarn can be produced by a conventional spinning technique without any difficulty, it may be understood that such blended spun yarn is the most preferable material to produce the pile cloth according to the present invention.

Another preferable material to be used as a pile yarn is one comprising a so-called island in a sea fiber as the fiber material to create the fiber "a" of the first group. For example, such yarn comprising the island in a sea fiber as the fiber material to create the fiber "a" of the first group and a fiber "b" of the second group spun in blended condition, or such yarn comprising the island in a sea fiber as a core element and a fiber "b" of the second group spun with the fiber "a" of the first group in the condition of a sheath element, or such doubled yarn comprising the island in a sea fibrous material in an endless condition and an element yarn composed of the fiber "b" of the second group, can be effectively used as the pile yarn to produce the pile cloth. In this case, it is preferable to remove the sea component of this island in a sea fiber by a known chemical treatment before carrying out an operation such as a raising operation.

It is well known that the individual pile fiber forming the under fur of genuine fur is generally shorter than the length of the individual pile fiber forming a layer of the guard hair thereof. Consequently, in the present invention, the material fiber "b" having a shorter length than the length of the material fiber "a" is normally used. As for the material fiber "b" of the second group, a fiber having two tapered end portions can be used, however, it is not essential to use such a material fiber "b." In other words, a normal fiber which does not have any tapered end portion can be used.

As for the material fiber "a" of the first group, which corresponds to the guard hair of genuine fur, either one of such fiber materials having a so-called square-cut fiber length or a so-called variable-cut fiber length can be used. If a material fiber of variable-cut fiber length is utilized, it is preferable to satisfy the condition that the length "L" of the pile 1 is not shorter than the average fiber length l of the above-mentioned material fiber "a" minus the effective locking length of the pile, or the above-mentioned length "L" of the pile 1 is preferably not shorter than the maximum length l of the fiber "a" of the first group minus the effective locking length of the pile.

As hereinbefore explained, a double fabric comprising two layers of ground construction which are connected by a plurality of pile yarns and each pile yarn is woven into the respective ground construction one by one, is preferably used for producing the pile cloth according to the present invention. However, there are also some modified methods to produce the pile cloth according to the present invention. For example, after the first step weft pile fabric provided with a plurality of floating wefts is produced, the floating wefts are cut so as to create a plurality of piles projected from the ground construction. Another modification is the application of the method of producing a plush fabric. And still another modification is the method of producing a conventional pile fabric provided with a plurality of looped pile yarns projected upward from the ground construction. In the last case, the length "L" regarding the looped pile projected upward from the ground construction is not shorter than the length defined by the maximum length of the material fiber "a" minus "the effective locking length of the pile on one side of the root portion of the above-mentioned loop pile." It has also been confirmed that the effective locking length of the pile is preferably five times the thickness of the ground construction of the pile cloth.

Figure 9:
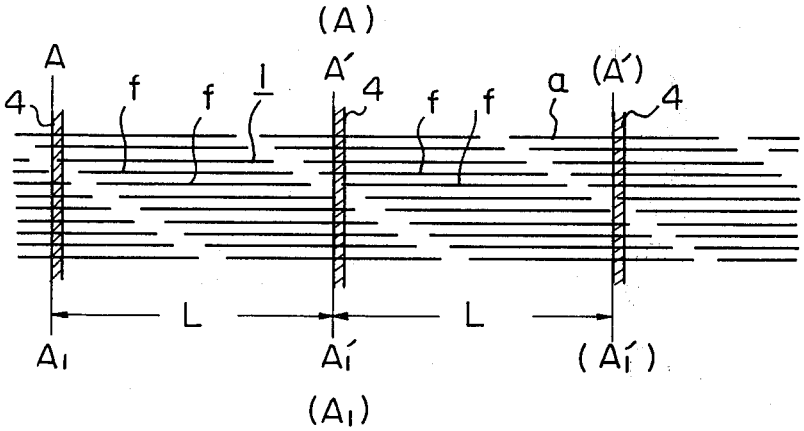
FIG. 9 is a model drawing of the pile yarn shown in FIG. 8, in the case of utilizing this yarn for producing a loop pile cloth for producing the artificial fur according to the present invention, wherein the length of the looped pile yarn of the fabric is L and the yarn is divided by a plurality of straight lines parpendicular to the lengthwise direction of the yarn on the condition that the distance of the two adjacent straight lines is L plus the effective locking length of pile in said ground construction.

Next, the above-mentioned method for producing a pile cloth according to the present invention from a pile fabric provided with a plurality of looped piles is explained in more detail, with reference to FIGS. 8 and 9. In FIG. 8, a part of the pile fabric provided with a plurality of looped piles, which is utilized as a fabric to produce the artificial fur of the present invention is shown. In this embodiment, it is required that the above-mentioned condition regarding the length "L" regarding each looped pile be satisfied. FIG. 9 indicates how to hold the fiber "a" contained in any pile yarn 1 by the ground construction 4. To simplify such construction, the pile yarn 1 concerned is represented by a straight band-like representation, wherein the schematic arrangement of the fiber "a" of the first group along the lengthwise direction of the pile yarn 1 with a certain shear is shown. In this drawing, the pile yarn 1 is formed by a plurality of straight zones which represent the ground construction 4 (in FIG. 8) perpendicular to the lengthwise direction of the pile yarn 1. The thickness of this zone represents the length of the root portion of the looped pile 1. In this drawing, the distance between two adjacent lines $AA_1$ and $A'A'_1$ should be set so as to satisfy the above-mentioned requirement regarding "L." Therefore, it can be easily understood from the drawing shown in FIG. 8 that there are some fibers "a" which are not held by the ground construction 4 in the condition that the length L regarding the looped pile 1 is larger than the maximum length of the material fiber "a." Such free fibers can be easily removed from the ground construction 4 of the pile fabric by applying a free-fiber removing operation such as a brushing action. If the length difference between the length L regarding the looped pile 1 and the maximum fiber length l of the material fiber "a" of the first group is large, many free fibers are created so that the rate of used material fibers to the removed fibers is increased.

In this embodiment, like the previous embodiment, it is preferable to treat the back side of the pile fabric by applying a chemical treatment, such as a backing treatment, so as to firmly hold the pile fibers in the ground construction. If a soft polyurethane resin is utilized for the backing treatment wherein this resin is immersed into the ground construction, an excellent feel of the pile fabric, which is similar to genuine fur, can be created. In this embodiment, if the raising operation is applied to the pile fabric shown in FIG. 8, since the free fibers can be removed easily from the pile yarn 1, the structural features mentioned in the introductory part of this specification can be effectively created.

As has been mentioned hereinbefore, the pile cloth according to the present invention is used for producing an artificial fur having excellent appearance, feel, drapability, and other functional features, which are similar to those of genuine fur. Therefore, the pile cloth produced by the above-mentioned method can be subjected to subsequent processes such as a piece-drying process, and finishing process such as an oiling or chemical treatment, etc. However, besides the above-mentioned processing, it is very important to carefully design the construction of the pile fabric together with the selection of material fibers which are used for not only the pile fibers "a" and "b" of the pile yarn 1. For example, to create excellent drapability in the artificial fur according to the present invention, the ground construction of this pile cloth is designed to be thin, or designed so as to be able to have a good stretchable property and/or less stiffness. Such design also contributes to improving the sewability of the artificial fur according to the present invention. For instance, a yarn made of such fibers as fusible fibers, island in a sea fibers or a very fine fiber, or a crimped textured yarn or an elastic yarn, etc., can be utilized for making the ground construction of the material pile cloth, according to the present invention.

According to research conducted by the inventors, it was found that, as to the yarn for making the ground construction of the material pile cloth, it is preferable to use a spun yarn composed of very fine staple fibers which are in a range from 0.005 to 0.9 denier, or a multifilament yarn composed of a plurality of very fine individual filaments having the above-mentioned range of fine denier; it is particularly desirable to use a yarn composed of a plurality of multi-core component fibers which are capable of separating into cores which are in a range between 0.005 and 0.9 denier.

As hereinbefore explained in detail, in the artificial fur according to the present invention, the structural features thereof are remarkably improved by applying such construction characterized by the shape of the free end portion of each pile fiber of guard hair, two layers of the pile fibers, the particular construction of the root portion of the pile fiber of guard hair, etc. Therefore, the pile fabric disclosed in the present invention contributes greatly to produce the artificial fur of the present invention having excellent properties such as a very elegant appearance and an almost natural feel, excellent quality of flutter, excellent drapability, etc., which are quite similar to those of genuine fur.

To clarify the characteristic feature of the present invention, several examples of the artificial fur and the method of producing the same according to the present invention will be hereinafter explained.

EXAMPLE 1

A pile fabric was made from a fabric having a so-called double velvet weaving construction according to the following conditions:

(a) Yarn for forming the ground construction: made from a spun yarn of 30S/2 composed of an island in a sea hypolymer fiber of 26 denier 51 mm length, wherein each individual fiber consisted of 16 island elements and the percentage of these island elements formed by polyethylene-terephthalate polymer in the the fiber was 90%, while the sea element was formed by polyethylene polymer.

(b) Pile yarn: made from a blended spun yarn composed of a first staple fiber of 50d×38 mm, which was a polybutylene terephthalate staple (Kaoline particle "ASP170," trademark, produced by ENGEL HARD, was added in the stage of polymerization), and a second staple fiber of 1.0d×18mm, which is a polybutylene terephthalate staple fiber, in the blend ratio of 35% of the first fiber and 65% of the second fiber. The first fiber was provided with two tapered end portions having a shape similar to the fiber shown in FIG. 5A.

(c) Density of the warp and filling yarn/25.4 mm: 60×55.

(d) Length of the cut pile: 40 mm.

After the conventional cutting operation was applied to the double velvet fabric for separating the two ground constructions, each of the thus produced pile fabrics was subjected to the following backing operation. That is, a polyurethane resin dissolved in a dimethylformamide solution was infused into the ground construction of the above-mentioned pile fabric, and thereafter the polyurethane resin was coagulated by removing the dimethylformamide component, and then the pile fabric was dried so that the polyurethane resin became part of the ground construction of the pile fabric.

Next, this pile fabric was subjected to the conventional raising operation so as to remove the free fibers contained in the pile from the ground construction. Based on a measuring test of the pile fibers, it was confirmed that the number of thicker pile fibers projecting upward from the ground construction forming the guard hairs was 400/cm$^2$, while the number of thinner fibers for forming the under fur in the final product was 14,000/cm$^2$. Thereafter, polystyrene, which is a sea component of the island in a sea fiber, was dissolved by utilizing toluene. Then the back surface of the above-mentioned treated pile fabric was rubbed with sandpaper, so that the polyethylene terephthalate fibers, which are the island component of the above-mentioned island in a sea fiber, were napped. Subsequent to the above-mentioned process, an oiling agent of a silicon emulsion of a 2.5% solution was sprayed upon the pile surface of the pile fabric in such a condition that the net weight of silicon absorbed by the pile fabric was 0.0125% of the weight of the pile fabric. Then an additional raising operation was applied to the pile surface of the pile fabric. The thus-produced pile fabric was provided with a suede-like ground construction; and an excellent appearance, feel, and also, a good quality of flutter, which were quite similar to genuine high grade fur, such as mink fur. Therefore, it was confirmed that the above-mentioned final pile fabric produced can be used as an artificial fur of very high quality.

EXAMPLE 2

A pile fabric was made from a fabric having a so-called double velvet weaving construction in the following conditions:

(a) Warp and filling yarns for forming the ground construction of the pile fabric: a spun yarn of 15$^s$/2 composed of a polyester staple fiber of 1.5d×51 mm.

(b) Pile yarn: a blended spun yarn of 8s composed of a polybutylene terephthalate staple fiber (40d×40 mm) and a polybutylene terephthalate staple fiber (1.5d×20 mm) in a blending ratio of 35% of the former thicker fiber and 65% of the latter thinner fiber, where the former thicker staple fiber is provided with two sharpened end portions, as shown in FIG. 5A, so as to form guard-hair-like pile fibers in the final product, the latter thinner fiber forming pile fibers of under hair in the final product.

(c) Yarn densities of the warp and filling yarns in the ground construction: 45×60/25.4 mm.

(d) Densities of the pile: 23 (in the warp direction)×40 (in the filling direction)/25.4 mm.

(e) Length of the cut pile: 40 mm

A backing operation was accomplished by applying a polyurethane 30% DMF solution to the pile fabric and treated pile fabric was subjected to multiple raising operations, after washing and extracting water from the washed material, so that each pile projecting from the ground construction even through the root portion thereof, was opened by means of eliminating twists of the yarn, and fibers, not firmly held by the ground construction, were removed from each pile yarn. The produced pile fabric was subjected to a polishing treatment, so that the undesirable turning or crimping tendency of the thicker fibers, which form the guard-hair-like pile fibers in the final product, was corrected, a desired luster of the thicker fiber was created, and a good lie of the hair was also achieved. After the foregoing steps were completed, the number of remaining pile fibers firmly held by the ground construction was measured. According to this experiment, it was found that the density of the pile fibers forming the guard hair in the final product was 350/cm$^2$ while the density of the pile fibers for forming the under fur in the final product was 11,000/cm$^2$.

As the subsequent step of processing, a softening operation using silicon which was identical to the operation explained in Example 1 was carried out on the pile fabric. After drying the pile fabric, an additional raising step was performed.

EXAMPLE 3

A pile fabric was made from a fabric having a so-called double velvet weaving construction according to the following conditions:

(a) Warp and filling yarns for forming the ground construction of the pile fabric were made from a spun yarn of 15$^s$/2 composed of a polyester staple fiber of 1.5d×51 mm.

(b) A pile yarn was made from a blended spun yarn of 17$^s$/2 composed of a polybutylene terephthalate staple fiber (30d×40 mm) and a cotton fiber (American Cotton fiber, thickness of about 2d, average fiber length 25 mm) in a blending ratio of 25% of the synthetic fiber and 75% of the cotton fiber, wherein the synthetic fiber was provided with two tapered end portions for forming a pile fiber of ground hair in the final product, and the cotton fiber formed the pile fibers of under hair in the final product.

(c) Yarn densities of the warp and filling yarns in the ground construction: 45×60/25.4 mm.

(d) Densities of the pile: 23 (in the warp direction)×40 (in the filling direction)/25.4 mm.

(e) Length of the cut pile: 40 mm.

A backing operation using a polyurethane 40% DMF solution was carried out on the pile fabric and the treated pile fabric was subjected to multiple raising operations after washing and extracting water from the washed material, so that each pile projected from the ground construction was opened from the root portion thereof by means of eliminating the twists of the yarn, and fibers, which were not firmly held by the ground construction, were removed from each pile yarn so that the undesirable turning or crimping tendency of the synthetic pile fiber for creating the guard hair was corrected. The thus-treated fabric was polished and corrected and a good lie of the hair was achieved. In this condition, the number of remaining pile fibers firmly held by the ground construction was measured. Based on the measurement, it was found that the density of the pile fibers for forming the guard hair in the final product was 300/cm$^2$, while the density of the pile fibers for forming the under fur in the final product was 8000/cm$^2$. The thus-produced pile fabric was subjected to a finishing process identical to that of Example 2, which involved the softening operation by a silicon emulsion and the additional raising operation. It was confirmed that this final product has excellent characteristic features as an artificial fur.

EXAMPLE 4

A pile cloth, in which a plurality of loop piles project from a ground construction of a conventional non-woven cloth made of polyester fibers, was produced by means of a conventional tufting machine. As the pile yarn, a blended spun yarn identical to the pile yarn used in Example 3, was utilized. The following conditions apply to the production of the above-mentioned pile cloth. That is, the length of the loop piles was 38 mm and the tufting operation was carried out at 10 stitches/25.4 mm. After a backing treatment, a raising operation was carried out so as to eliminate the twist from the pile yarn from the root portion thereof; accordingly, free fibers in each loop pile, which were not firmly held by the non-woven cloth, were removed from the ground construction, so that each loop pile was changed to a bundle of pile fibers projected from the ground construction. The thus-produced pile cloth was piece-dye a dark brown mink color by means of a conventional circular dyeing machine. The dyeing operation was carried out in the following manner:

(a) The first step of dyeing was carried out by utilizing a disperse dyestuff, at 125° C., for 1 hour.

(b) The second step of dyeing was carried out by utilizing a reactive dyestuff, at 80° C., for 1 hour.

(c) The third step was a washing and drying operation. In the above-mentioned dyeing operation, the polybutylene terephthalate staple fiber was dyed in the first step of the dyeing operation, and the cotton fiber was dyed in the second step of the dyeing operation.

The thus-produced pile cloth was subjected to a finishing operation similar to that of Example 3. It was confirmed that the final product of this example can be used as a high quality artificial fur.

In a modification of Example 4, the above-mentioned dyeing operation may be carried out at a stage before the raising operation of the backing operation.

EXAMPLE 5

A warp pile fabric was made from a fabric having a so-called double velvet weaving construction according to the following conditions:

(a) Warp and filling yarns for forming the ground construction of the pile fabric were made from a spun yarn of 15$^s$/2 composed of a polyester staple fiber of 1.5d×51 mm.

(b) A pile yarn was made from a blended spun yarn of 8s composed of a polybutylene terephthalate staple fiber (40d×40 mm) and a polybutylene terephthalate staple fiber (1.5d×20 mm, number of crimps 15/25.4 mm, crimp ratio 10%) in a blending ratio of 35% of the former thicker fiber and 65% of the latter thinner fiber, wherein the former thicker staple fiber was provided with two sharpened end portions, as shown in FIG. 5A, so as to form pile fibers of the guard hair in the final product, while the thinner fiber formed the pile fibers of under hair in the final product.

(c) Yarn densities of the warp and filling yarns in the ground construction: 45×60/25.4 mm.

(d) Densities of the pile: 23(in the warp direction)×40(in the filling direction)/25.4 mm.

(e) Length of the cut pile (pile length): 35 mm.

A polyurethane 30% DMF solution was applied to the pile fabric in a backing operation, and the treated pile fabric was subjected to multiple raising operations after washing and extracting water from the washed material, so that the twist of the piles were eliminated from the root portion thereof and the free fibers in each pile portion, which were not firmly held by the ground construction, were removed from the ground construction of the pile fabric. In this condition, the number of pile fibers projecting from the ground construction was measured. The following is the data of this measurement.

The number of the thicker fibers was 370/cm$^2$, while the number of the thinner fibers was 12,000/cm$^2$. In the pile fabric thus produced, it was observed that the number of crimps formed in each of the thinner staple fibers was reduced to almost half of the original number, while the length of the pile fibers for forming the guard hair in the pile fabric was almost 35 mm, which is shorter than the staple length in the untreated condition. However, since a bottom end portion of the thicker fiber was firmly held by the ground construction, in other words, the bottom end portion of this fiber, which was almost 5 mm length, was held by the ground construction, it could be confirmed that the sharpened free end portion of these pile fibers was not damaged very much by the above-mentioned raising operation. The thus-produced pile fabric was subjected to a finishing operation similar to that of Example 2, and it was confirmed that the pile fabric thus obtained had excellent structural features, which satisfied the requirement of an artificial fur of very high quality, having a mink-like appearance and other features.

We claim:

1. An aritifical fur comprising;

a ground construction and numerous units of pile fibers projected upward from said ground construction, said unit of pile fibers provided with a yarn-like bundle of a root portion, at least a main part of said root portion firmly locked in said ground construction, said pile fibers of each unit being separated from each other from the position above said root portion, said pile fibers being made from fibrous materials and provided with varied lengths thereof in a range from almost zero to almost identical to the maximum length of said fibrous materials, each unit of pile fibers comprising a group of fibers having tapered top end portions and a group of fibers substantially shorter and thinner than the above-mentioned fiber group, the first group functioning as guard hairs and the second group functioning as under fur and in the pile fabric, the yarn for the ground construction of the pile fabric and the yarn for the pile fibers are different, and, in the pile fabric said root portion of the yarn for creating the pile fibers maintains its yarn structure in the ground construction thereof.

2. An artificial fur according to claim 1, wherein a part of said pile fibers are provided with a tapered free end portion respectively.

3. An artificial fur according to claim 2, wherein at least a part of said pile fibers are provided with the respective tapered free end portions further provided with a tapered bottom portion adjacently above said root portion respectively.

4. An artificial fur according to claim 1, wherein said yarn-like bundle of the root portion of said unit of pile fibers is not projected above said ground construction.

5. An artificial fur according to claim 1, wherein said pile fibers are formed in part of relatively short and fine fibers constituting an under fur and in part of relatively large diameter straight fibers projecting from said under fur as guard hairs, said guard hairs are tapered substantially at the free end portion thereof.

6. An artificial fur according to claim 5, wherein at least a part of said guard hairs are further tapered at the bottom portion thereof adjacently above said root portion of each unit of pile fibers, respectively.

7. An artificial fur according to claim 5, wherein a part of said relatively short and fine pile fibers are tapered substantially at the free end portion thereof.

8. An artificial fur according to claim 1, wherein said pile fibers of each unit of pile fibers are formed in part of relatively short and fine fibers constituting an under fur and in part of relatively large diameter straight fibers projecting from said under fur as guard hairs, said guard hairs are tapered substantially at the free end portion thereof.

9. An artificial fur according to claim 8, wherein at least a part of said guard hairs are further tapered at the bottom portion thereof adjacently above said root portion of each unit of pile fibers respectively.

10. An artificial fur according to claim 8, wherein the density of said pile fibers as guard hairs is more than 150/cm$^2$.

11. An artificial fur according to claim 8, wherein the thickness of the thickest portion of each pile fiber as guard hair is in a range between 15 and 100 denier.

12. An artificial fur according to claim 8, wherein the thickness of the most thickest portion of said pile fibers as guard hair is in a range of from 30 denier to 80 denier, while the thickness of said pile fibers forming said under fur is in a range between 0.5 and 10 denier.

13. An artificial fur according to claim 1, further comprising a backing layer formed on a backside surface of said ground construction.

14. An artificial fur according to claim 1, wherein said yarn-like bundle of root portion formed by a plurality of said pile fibers is provided with twists.

15. An artificial fur according to claim 1, wherein the density of said pile fibers is more than $5\times10^3$/cm$^2$.

16. An artificial fur according to claim 1, wherein said ground construction is a woven construction.

17. An artificial fur according to claim 1, wherein said ground construction is a non-woven cloth construction.

18. An artificial fur according to claim 1, wherein said ground construction is treated with a backing substance.

19. A method of manufacturing an artificial fur comprising:

a ground construction and numerous units of pile fibers projected upward from said ground construction wherein each unit of pile fibers comprising a group of fibers having tapered top end portions and a group of fibers substantially shorter and thinner than the above-mentioned fiber group, the first group functioning as guard hairs and the second group functioning as under fur, the yarn for the ground construction of the pile fabric and the yarn for the pile fibers are different, and, in the pile fabric, said root portion of the yarn for creating the pile fibers maintains its yarn structure in the ground construction thereof; ccomprising:

a first step of creating a construction of pile cloth consisting of a ground construction and numerous yarn-like pile units projected upward from said ground construction by utilizing a yarn-like substance;

a second step of raising said pile cloth so that some of said fibers of which are not firmly held by said ground construction are removed, while opening said fibers, which are firmly held by said ground construction;

a third step of finishing the product of said second step.

20. A method of manufacturing an artificial fur according to claim 19, wherein said yarn-like substance is composed of component fibers of a first group for creating said guard hairs and the other component fibers of a second group.

21. A method for manufacturing an artificial fur according to claim 20, wherein each fiber of said first group is provided with a definite length longer than a definite length of said fiber of said second group, said fiber of said first group is provided with two tapered end portions thereof, the main portion of said component fiber of said first group is thicker than the thickness of said fiber of said second group.

22. A method for manufacturing an artificial fur according to claim 19, further comprising an intermediate step of dyeing the product of said second step between said first and third step of processing, whereby said third step of finishing is applied to the product of said intermediate step of processing.

23. A method for manufacturing an artificial fur according to claim 19, further comprising an intermediate step of backing said ground construction between said first and second step of processing.

24. A method of manufacturing an artificial fur according to claim 23, wherein said backing operation is carried out by infusing a backing substance into said ground construction.

25. A method of manufacturing an artificial fur according to claim 24, wherein said backing substance is a dimethylformamide solution of polyurethane.

26. A method of manufacturing an artificial fur according to claim 19, wherein said yarn-like pile units are yarn-like cut pile, each cut pile is provided with a cut length not shorter than the length defined by "the length of mean or maximum fiber length of the component fiber of said cut pile projected upward from said ground construction" minus "the effective locking length of the pile by said ground construction."

27. A method of manufacturing an artificial fur according to claim 26, wherein said effective locking length of the pile is five times of the thickness of said ground construction.

28. A method of manufacturing an artificial fur according to claim 19, wherein said yarn-like pile units are yarn-like loop pile, the length of said loop pile is not shorter than the length defined by "the length of mean or maximum fiber length of the component fiber of said loop pile projected upward from said ground construction" minus "the effective locking length of one side portion of said loop pile by said ground construction."

29. A method of manufacturing an artificial fur according to claim 28, wherein said effective locking length of the pile is five times of the thickness of said ground construction.

30. A method of manufacturing an artificial fur according to claim 19, wherein said yarn-like substance is a blended spun yarn of at least said component fibers of said first and second groups.

31. A method of manufacturing an artificial fur according to claim 30, wherein said blended spun yarn is composed of said fibers for creating guard hair like pile fibers in a weight ratio 20 to 70% and said fibers for creating ground fur in a weight ratio 80 to 30%, respectively.

32. A method of manufacturing an artificial fur according to claim 19, wherein the thickness of the thickest portion of said fiber for creating guard hair like pile fiber is in a range between 30 and 80 denier, while the thickness of said fiber for creating said under fur is in a range between 0.5 and 10 denier.

33. A method of manufacturing a pile cloth for producing an artificial fur according to claim 19, wherein the length of said fiber for creating said guard hair, is in a range between 15 and 60 mm.

34. A method of manufacturing a pile cloth for producing an artificial fur according to claim 19, wherein length of said fiber for creating said guard hair is in a range between 20 and 50 mm, while length of said fiber for creating said under fur is in a range between 15 and 40 mm.

35. A method of manufacturing a pile cloth for producing an artificial fur according to claim 19, wherein said ground construction is a woven construction, and said first step is carried out by a weaving operation.

36. A method of manufacturing an artificial fur according to claim 19, wherein said ground construction is a non-woven construction, and said first step is carried out by a tufting said yarn upon said ground construction.

37. A method of manufacturing an artificial fur according to claim 19, wherein said third step of said finishing operation is a softening operation.

38. A method of manufacturing an artificial fur according to claim 37, wherein said softening operation is carried out with silicon emulsion.

39. A method of manufacturing an artificial fur according to claim 19, wherein said ground construction of a pile cloth produced in said first step of processing contains an island in a sea fibrous material, further comprising a step of dissolving the sea component of said island in a sea fibrous material from said ground construction.

40. A method of manufacturing an artificial fur according to claim 39, wherein the finishing operation involves an additional operation of rubbing the back surface of said ground construction.

* * * * *

UNITED STATES PATENT AND TRADEMARK OFFICE

CERTIFICATE OF CORRECTION

PATENT NO. : 4,415,611

DATED : 11/15/83

INVENTOR(S) : Seiichi Yamagata and Masaaki Sakai

It is certified that error appears in the above-identified patent and that said Letters Patent is hereby corrected as shown below:

Column 1, line 47, after "characteristics" insert --are--.

Column 4, line 23, after "appearance" insert --feel--.

Signed and Sealed this

*Thirty-first* Day of *July 1984*

[SEAL]

*Attest:*

GERALD J. MOSSINGHOFF

*Attesting Officer*

*Commissioner of Patents and Trademarks*